US006434519B1

(12) United States Patent
Manjunath et al.

(10) Patent No.: US 6,434,519 B1
(45) Date of Patent: Aug. 13, 2002

(54) METHOD AND APPARATUS FOR IDENTIFYING FREQUENCY BANDS TO COMPUTE LINEAR PHASE SHIFTS BETWEEN FRAME PROTOTYPES IN A SPEECH CODER

(75) Inventors: Sharath Manjunath; Andrew P. Dejaco; Arasanipalai K. Ananthapadmanabhan; Pengjun Huang; Eddie Lun Tik Choy, all of San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 09/356,861

(22) Filed: Jul. 19, 1999

(51) Int. Cl.[7] ..... G10L 19/14; G10L 19/08
(52) U.S. Cl. ..... 704/205; 704/201
(58) Field of Search ..... 704/205, 200–204, 704/220, 223, 213, 201

(56) References Cited

U.S. PATENT DOCUMENTS

| | | | | |
|---|---|---|---|---|
| 4,941,152 A | * | 7/1990 | Medan | 704/200 |
| 5,574,823 A | | 11/1996 | Hassanein et al. | |
| 5,583,784 A | * | 12/1996 | Kapust et al. | 704/203 |
| 5,664,056 A | * | 9/1997 | Akagiri | 704/204 |
| 5,668,925 A | * | 9/1997 | Rothweiler et al. | 704/220 |
| 5,684,926 A | | 11/1997 | Huang et al. | |
| 5,884,253 A | * | 3/1999 | Kleijn | 704/223 |

FOREIGN PATENT DOCUMENTS

FR 2766032 1/1999

OTHER PUBLICATIONS

M. El–Sharkawy, et al. A DSP56156 Wideband Coder, International Journal of Computers & Applications, US, ACTA Press, Anaheim, CA, vol. 19, No. 1, 1997, pp. 31–37.

"Linear Predictive Coding of Speech", *Digital Processing of Speech Signals*, Rabiner et al., (1978) pp. 396–461.

1978 Digital Processing of Speech Signals, "Linear Predictive Coding of Speech", L.R. Rabiner et al., pp. 411–413.

1988 Proceedings of the Mobile Satellite Conference, "A 4.8 KBPS Code Excited Linear Predictive Coder", T. Tremain et al., pp. 491–496.

1991 Digital Signal Processing, "Methods for Waveform Interpolation in Speech Coding", W. Bastiaan Kleijn, et al., pp. 215–230.

* cited by examiner

*Primary Examiner*—Richemond Dorvil
*Assistant Examiner*—Daniel A. Nolan
(74) *Attorney, Agent, or Firm*—Philip Wadsworth; Thomas R. Rouse; Byron Yafuso

(57) ABSTRACT

A method and apparatus for identifying frequency bands to compute linear phase shifts between frame prototypes in a speech coder includes partitioning the frequency spectrum of a prototype of a frame by dividing the frequency spectrum into segments, assigning one or more bands to each segment, and establishing, for each segment, a set of bandwidths for the bands. The bandwidths may be fixed and uniformly distributed in any given segment. The bandwidths may be fixed and non-uniformly distributed in any segment. The bandwidths may be variable and non-uniformly distributed in any given segment.

18 Claims, 7 Drawing Sheets

METHOD AND APPARATUS FOR IDENTIFYING FREQUENCY BANDS TO COMPUTE LINEAR PHASE SHIFTS BETWEEN FRAME PROTOTYPES IN A SPEECH CODER

BACKGROUND OF THE INVENTION

I. Field of the Invention

The present invention pertains generally to the field of speech processing, and more specifically to methods and apparatus for identifying frequency bands to compute linear phase shifts between frame prototypes in speech coders.

II. Background

Transmission of voice by digital techniques has become widespread, particularly in long distance and digital radio telephone applications. This, in turn, has created interest in determining the least amount of information that can be sent over a channel while maintaining the perceived quality of the reconstructed speech. If speech is transmitted by simply sampling and digitizing, a data rate on the order of sixty-four kilobits per second (kbps) is required to achieve a speech quality of conventional analog telephone. However, through the use of speech analysis, followed by the appropriate coding, transmission, and resynthesis at the receiver, a significant reduction in the data rate can be achieved.

Devices for compressing speech find use in many fields of telecommunications. An exemplary field is wireless communications. The field of wireless communications has many applications including, for example, cordless telephones, paging, wireless local loops, wireless telephony such as cellular and PCS telephone systems, mobile Internet Protocol (IP) telephony, and satellite communication systems. A particularly important application is wireless telephony for mobile subscribers.

Various over-the-air interfaces have been developed for wireless communication systems including, for example, frequency division multiple access (FDMA), time division multiple access (TDMA), and code division multiple access (CDMA). In connection therewith, various domestic and international standards have been established including, for example, Advanced Mobile Phone Service (AMPS), Global System for Mobile Communications (GSM), and Interim Standard 95 (IS-95). An exemplary wireless telephony communication system is a code division multiple access (CDMA) system. The IS-95 standard and its derivatives, IS-95A, ANSI J-STD-008, IS-95B, proposed third generation standards IS-95C and IS-2000, etc. (referred to collectively herein as IS-95), are promulgated by the Telecommunication Industry Association (TIA) and other well known standards bodies to specify the use of a CDMA over-the-air interface for cellular or PCS telephony communication systems. Exemplary wireless communication systems configured substantially in accordance with the use of the IS-95 standard are described in U.S. Pat. Nos. 5,103,459 and 4,901,307, which are assigned to the assignee of the present invention and fully incorporated herein by reference.

Devices that employ techniques to compress speech by extracting parameters that relate to a model of human speech generation are called speech coders. A speech coder divides the incoming speech signal into blocks of time, or analysis frames. Speech coders typically comprise an encoder and a decoder. The encoder analyzes the incoming speech frame to extract certain relevant parameters, and then quantizes the parameters into binary representation, i.e., to a set of bits or a binary data packet. The data packets are transmitted over the communication channel to a receiver and a decoder. The decoder processes the data packets, unquantizes them to produce the parameters, and resynthesizes the speech frames using the unquantized parameters.

The function of the speech coder is to compress the digitized speech signal into a low-bit-rate signal by removing all of the natural redundancies inherent in speech. The digital compression is achieved by representing the input speech frame with a set of parameters and employing quantization to represent the parameters with a set of bits. If the input speech frame has a number of bits $N_i$ and the data packet produced by the speech coder has a number of bits $N_o$ the compression factor achieved by the speech coder is $C_r=N_i/N_o$. The challenge is to retain high voice quality of the decoded speech while achieving the target compression factor. The performance of a speech coder depends on (1) how well the speech model, or the combination of the analysis and synthesis process described above, performs, and (2) how well the parameter quantization process is performed at the target bit rate of $N_o$ bits per frame. The goal of the speech model is thus to capture the essence of the speech signal, or the target voice quality, with a small set of parameters for each frame.

Perhaps most important in the design of a speech coder is the search for a good set of parameters (including vectors) to describe the speech signal. A good set of parameters requires a low system bandwidth for the reconstruction of a perceptually accurate speech signal. Pitch, signal power, spectral envelope (or formants), amplitude spectra, and phase spectra are examples of the speech coding parameters.

Speech coders may be implemented as time-domain coders, which attempt to capture the time-domain speech waveform by employing high time-resolution processing to encode small segments of speech (typically 5 millisecond (ms) subframes) at a time. For each subframe, a high-precision representative from a codebook space is found by means of various search algorithms known in the art. Alternatively, speech coders may be implemented as frequency-domain coders, which attempt to capture the short-term speech spectrum of the input speech frame with a set of parameters (analysis) and employ a corresponding synthesis process to recreate the speech waveform from the spectral parameters. The parameter quantizer preserves the parameters by representing them with stored representations of code vectors in accordance with known quantization techniques described in A. Gersho & R. M. Gray, *Vector Quantization and Signal Compression* (1992).

A well-known time-domain speech coder is the Code Excited Linear Predictive (CELP) coder described in L. B. Rabiner & R. W. Schafer, *Digital Processing of Speech Signals* 396–453 (1978), which is fully incorporated herein by reference. In a CELP coder, the short term correlations, or redundancies, in the speech signal are removed by a linear prediction (LP) analysis, which finds the coefficients of a short-term formant filter. Applying the short-term prediction filter to the incoming speech frame generates an LP residue signal, which is further modeled and quantized with long-term prediction filter parameters and a subsequent stochastic codebook. Thus, CELP coding divides the task of encoding the time-domain speech waveform into the separate tasks of encoding the LP short-term filter coefficients and encoding the LP residue. Time-domain coding can be performed at a fixed rate (i.e., using the same number of bits, $N_o$, for each frame) or at a variable rate (in which different bit rates are used for different types of frame contents). Variable-rate coders attempt to use only the amount of bits needed to encode the codec parameters to a level adequate to obtain a target quality. An exemplary variable rate CELP coder is described in U.S. Pat. No. 5,414,796, which is assigned to the assignee of the present invention and fully incorporated herein by reference.

Time-domain coders such as the CELP coder typically rely upon a high number of bits, $N_o$, per frame to preserve the accuracy of the time-domain speech waveform. Such coders typically deliver excellent voice quality provided the number of bits, $N_o$, per frame relatively large (for example, 8 kbps or above). However, at low bit rates (4 kbps and below), time-domain coders fail to retain high quality and robust performance due to the limited number of available bits. At low bit rates, the limited codebook space clips the waveform-matching capability of conventional time-domain coders, which are so successfully deployed in higher-rate commercial applications. Hence, despite improvements over time, many CELP coding systems operating at low bit rates suffer from perceptually significant distortion typically characterized as noise.

There is presently a surge of research interest and strong commercial need to develop a high-quality speech coder operating at medium to low bit rates (i.e., in the range of 2.4 to 4 kbps and below). The application areas include wireless telephony, satellite communications, Internet telephony, various multimedia and voice-streaming applications, voice mail, and other voice storage systems. The driving forces are the need for high capacity and the demand for robust performance under packet loss situations. Various recent speech coding standardization efforts are another direct driving force propelling research and development of low-rate speech coding algorithms. A low-rate speech coder creates more channels, or users, per allowable application bandwidth, and a low-rate speech coder coupled with an additional layer of suitable channel coding can fit the overall bit-budget of coder specifications and deliver a robust performance under channel error conditions.

One effective technique to encode speech efficiently at low bit rates is multimode coding. An exemplary multimode coding technique is described in U.S. application Ser. No. 09/217,341, entitled VARIABLE RATE SPEECH CODING, filed Dec. 21, 1998, assigned to the assignee of the present invention, and fully incorporated herein by reference. Conventional multimode coders apply different modes, or encoding-decoding algorithms, to different types of input speech frames. Each mode, or encoding-decoding process, is customized to optimally represent a certain type of speech segment, such as, e.g., voiced speech, unvoiced speech, transition speech (e.g., between voiced and unvoiced), and background noise (nonspeech) in the most efficient manner. An external, open-loop mode decision mechanism examines the input speech frame and makes a decision regarding which mode to apply to the frame. The open-loop mode decision is typically performed by extracting a number of parameters from the input frame, evaluating the parameters as to certain temporal and spectral characteristics, and basing a mode decision upon the evaluation.

Coding systems that operate at rates on the order of 2.4 kbps are generally parametric in nature. That is, such coding systems operate by transmitting parameters describing the pitch-period and the spectral envelope (or formants) of the speech signal at regular intervals. Illustrative of these so-called parametric coders is the LP vocoder system.

LP vocoders model a voiced speech signal with a single pulse per pitch period. This basic technique may be augmented to include transmission information about the spectral envelope, among other things. Although LP vocoders provide reasonable performance generally, they may introduce perceptually significant distortion, typically characterized as buzz.

In recent years, coders have emerged that are hybrids of both waveform coders and parametric coders. Illustrative of these so-called hybrid coders is the prototype-waveform interpolation (PWI) speech coding system. The PWI coding system may also be known as a prototype pitch period (PPP) speech coder. A PWI coding system provides an efficient method for coding voiced speech. The basic concept of PWI is to extract a representative pitch cycle (the prototype waveform) at fixed intervals, to transmit its description, and to reconstruct the speech signal by interpolating between the prototype waveforms. The PWI method may operate either on the LP residual signal or the speech signal. An exemplary PWI, or PPP, speech coder is described in U.S. application Ser. No. 09/217,494, entitled PERIODIC SPEECH CODING, filed Dec. 21, 1998, assigned to the assignee of the present invention, and fully incorporated herein by reference. Other PWI, or PPP, speech coders are described in U.S. Pat. No. 5,884,253 and W. Bastiaan Kleijn & Wolfgang Granzow *Methods for Waveform Interpolation in Speech Coding, in* 1 *Digital Signal Processing* 215–230 (1991).

In conventional speech coders, all of the phase information for each pitch prototype in each frame of speech is transmitted. However, in low-bit-rate speech coders, it is desirable to conserve bandwidth to the extent possible. Accordingly, it would be advantageous to provide a method of transmitting fewer phase parameters. Thus, there is a need for a speech coder that transmits less phase information per frame.

SUMMARY OF THE INVENTION

The present invention is directed to a speech coder that transmits less phase information per frame. Accordingly, in one aspect of the invention, a method of partitioning the frequency spectrum of a prototype of a frame advantageously includes the steps of dividing the frequency spectrum into a plurality of segments; assigning a plurality of bands to each segment; and establishing, for each segment, a set of bandwidths for the plurality of bands.

In another aspect of the invention, a speech coder configured to partition the frequency spectrum of a prototype of a frame advantageously includes means for dividing the frequency spectrum into a plurality of segments; means for assigning a plurality of bands to each segment; and means for establishing, for each segment, a set of bandwidths for the plurality of bands.

In another aspect of the invention, a speech coder advantageously includes a prototype extractor configured to extract a prototype from a frame being processed by the speech coder; and a prototype quantizer coupled to the prototype extractor and configured to divide the frequency spectrum of the prototype into a plurality of segments, assign a plurality of bands to each segment, and establish, for each segment, a set of bandwidths for the plurality of bands.

DETAILED DESCRIPTION OF THE PREFERRED EMBODIMENTS

The exemplary embodiments described hereinbelow reside in a wireless telephony communication system configured to employ a CDMA over-the-air interface. Nevertheless, it would be understood by those skilled in the art that a subsampling method and apparatus embodying features of the instant invention may reside in any of various communication systems employing a wide range of technologies known to those of skill in the art.

Figure 1:
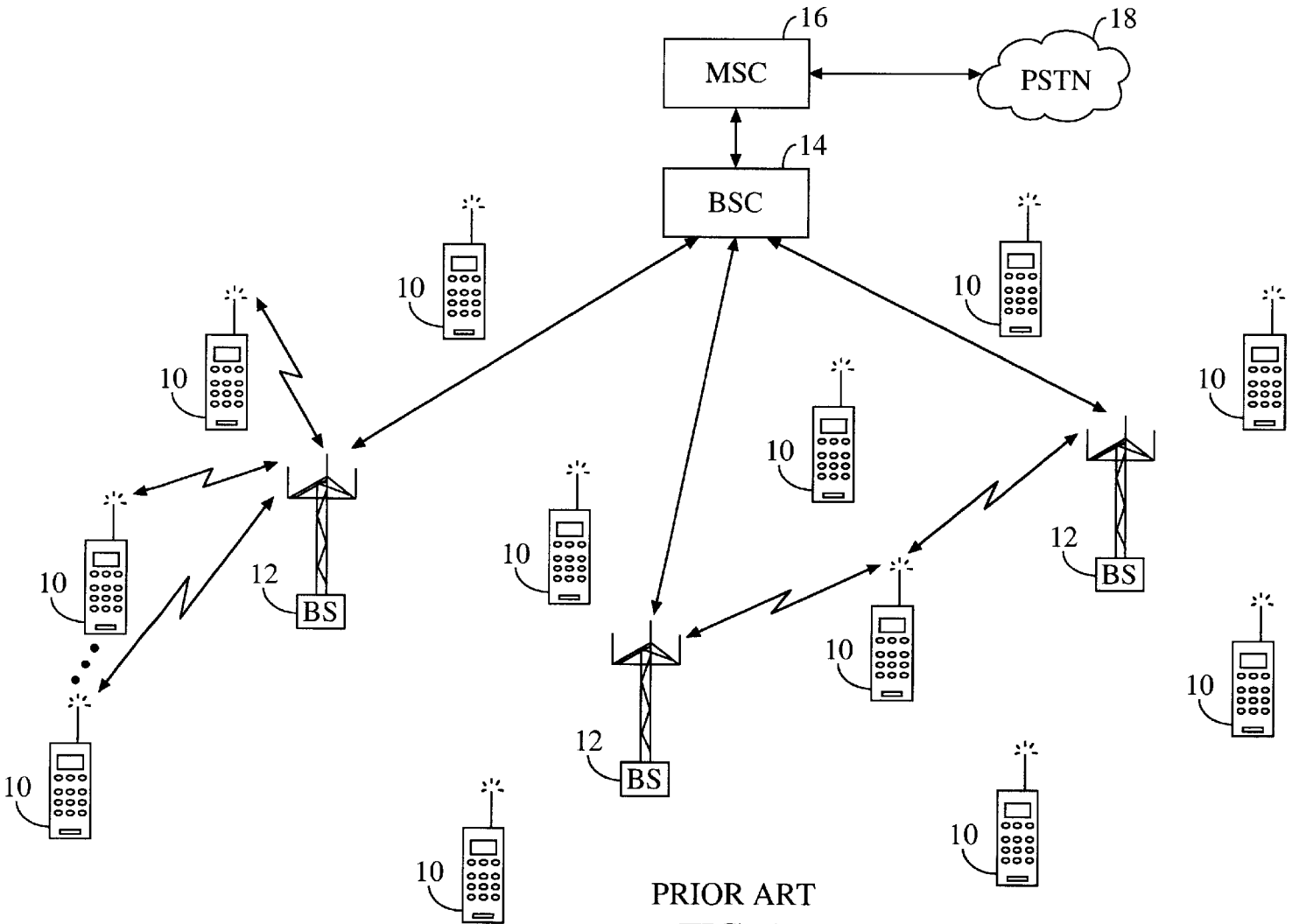
PRIOR ART FIG. 1
FIG. 1 is a block diagram of a wireless telephone system.

As illustrated in FIG. 1, a CDMA wireless telephone system generally includes a plurality of mobile subscriber units 10, a plurality of base stations 12, base station controllers (BSCs) 14, and a mobile switching center (MSC) 16. The MSC 16 is configured to interface with a conventional public switch telephone network (PSTN) 18. The MSC 16 is also configured to interface with the BSCs 14. The BSCs 14 are coupled to the base stations 12 via backhaul lines. The backhaul lines may be configured to support any of several known interfaces including, for example, E1/T1, ATM, IP, PPP, Frame Relay, HDSL, ADSL, or xDSL. It is understood that there may be more than two BSCs 14 in the system. Each base station 12 advantageously includes at least one sector (not shown), each sector comprising an omnidirectional antenna or an antenna pointed in a particular direction radially away from the base station 12. Alternatively, each sector may comprise two antennas for diversity reception. Each base station 12 may advantageously be designed to support a plurality of frequency assignments. The intersection of a sector and a frequency assignment may be referred to as a CDMA channel. The base stations 12 may also be known as base station transceiver subsystems (BTSs) 12. Alternatively, "base station" may be used in the industry to refer collectively to a BSC 14 and one or more BTSs 12. The BTSs 12 may also be denoted "cell sites" 12. Alternatively, individual sectors of a given BTS 12 may be referred to as cell sites. The mobile subscriber units 10 are typically cellular or PCS telephones 10. The system is advantageously configured for use in accordance with the IS-95 standard.

During typical operation of the cellular telephone system, the base stations 12 receive sets of reverse link signals from sets of mobile units 10. The mobile units 10 are conducting telephone calls or other communications. Each reverse link signal received by a given base station 12 is processed within that base station 12. The resulting data is forwarded to the BSCs 14. The BSCs 14 provides call resource allocation and mobility management functionality including the orchestration of soft handoffs between base stations 12. The BSCs 14 also routes the received data to the MSC 16, which provides additional routing services for interface with the PSTN 18. Similarly, the PSTN 18 interfaces with the MSC 16, and the MSC 16 interfaces with the BSCs 14, which in turn control the base stations 12 to transmit sets of forward link signals to sets of mobile units 10.

Figure 2:
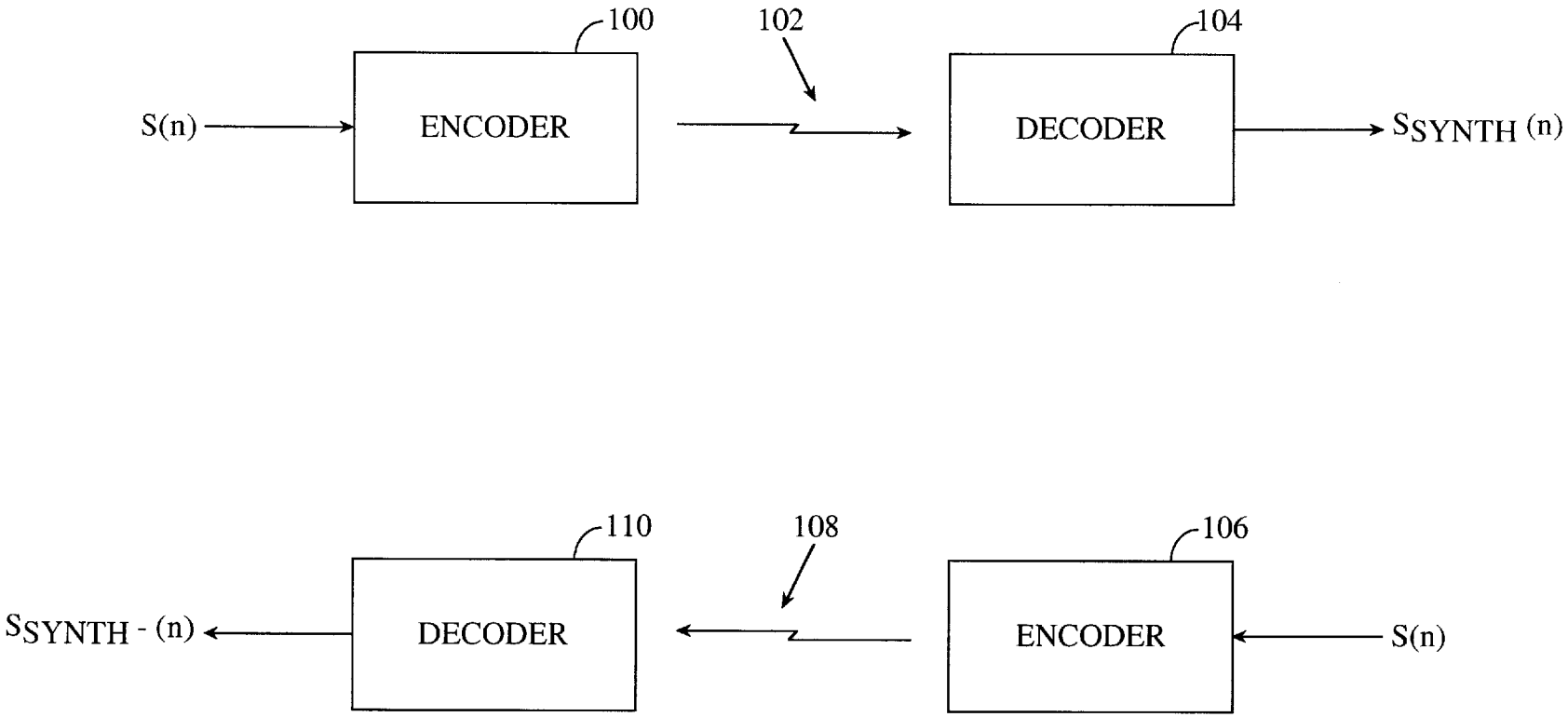
FIG. 2 is a block diagram of a communication channel terminated at each end by speech coders.

In FIG. 2 a first encoder 100 receives digitized speech samples s(n) and encodes the samples s(n) for transmission on a transmission medium 102, or communication channel 102, to a first decoder 104. The decoder 104 decodes the encoded speech samples and synthesizes an output speech signal $s_{SYNTH}(n)$. For transmission in the opposite direction, a second encoder 106 encodes digitized speech samples s(n), which are transmitted on a communication channel 108. A second decoder 110 receives and decodes the encoded speech samples, generating a synthesized output speech signal $s_{SYNTH}(n)$.

The speech samples s(n) represent speech signals that have been digitized and quantized in accordance with any of various methods known in the art including, for example, pulse code modulation (PCM), companded $\mu$-law, or A-law. As known in the art, the speech samples s(n) are organized into frames of input data wherein each frame comprises a predetermined number of digitized speech samples s(n). In an exemplary embodiment, a sampling rate of 8 kHz is employed, with each 20 ms frame comprising 160 samples. In the embodiments described below, the rate of data transmission may advantageously be varied on a frame-to-frame basis from 13.2 kbps (full rate) to 6.2 kbps (half rate) to 2.6 kbps (quarter rate) to 1 kbps (eighth rate). Varying the data transmission rate is advantageous because lower bit rates may be selectively employed for frames containing relatively less speech information. As understood by those skilled in the art, other sampling rates, frame sizes, and data transmission rates may be used.

The first encoder 100 and the second decoder 110 together comprise a first speech coder, or speech codec. The speech coder could be used in any communication device for transmitting speech signals, including, for example, the subscriber units, BTSs, or BSCs described above with reference to FIG. 1. Similarly, the second encoder 106 and the first decoder 104 together comprise a second go speech coder. It is understood by those of skill in the art that speech coders may be implemented with a digital signal processor (DSP), an application-specific integrated circuit (ASIC), discrete gate logic, firmware, or any conventional programmable software module and a microprocessor. The software module could reside in RAM memory, flash memory, registers, or any other form of writable storage medium known in the art. Alternatively, any conventional processor, controller, or state machine could be substituted for the microprocessor. Exemplary ASICs designed specifically for speech coding are described in U.S. Pat. No. 5,727,123, assigned to the assignee of the present invention and fully incorporated herein by reference, and U.S. application Ser. No. 08/197,417, entitled VOCODER ASIC, filed Feb. 16, 1994, assigned to the assignee of the present invention, and fully incorporated herein by reference.

Figure 3:
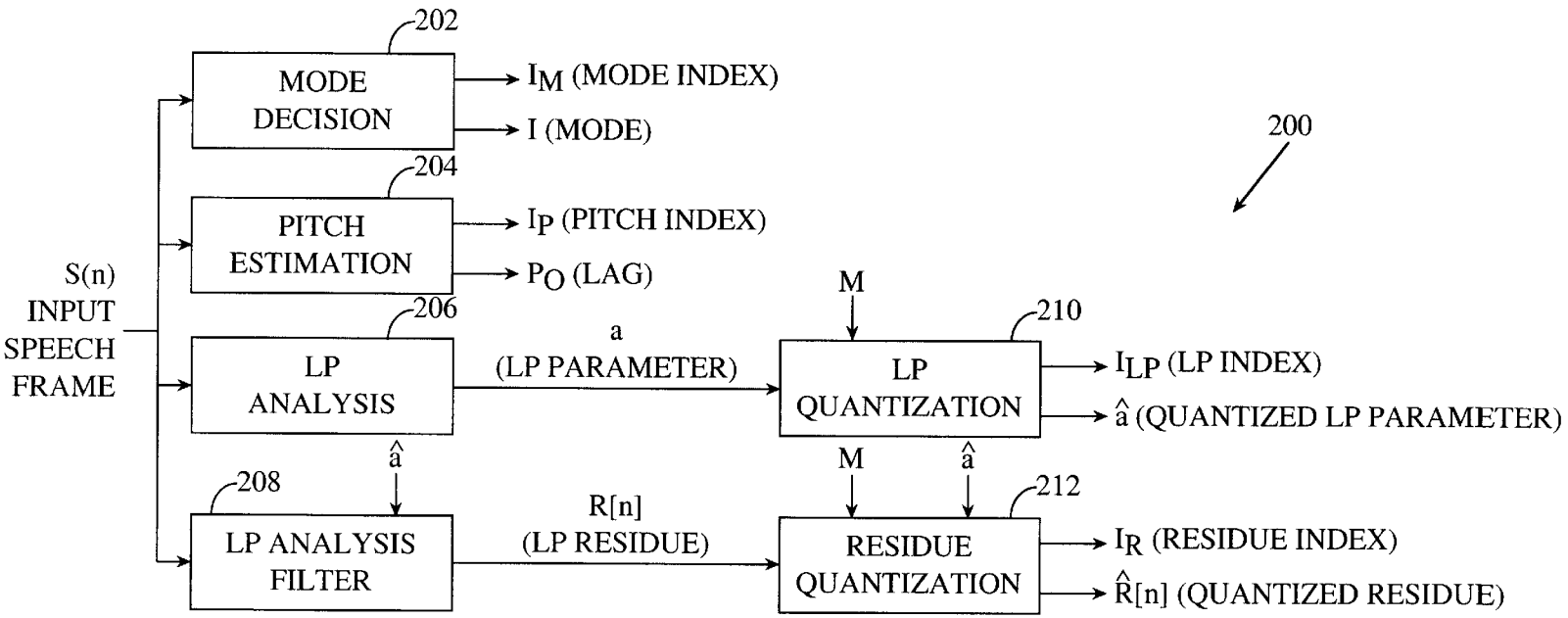
FIG. 3 is a block diagram of an encoder.

In FIG. 3 an encoder 200 that may be used in a speech coder includes a mode decision module 202, a pitch estimation module 204, an LP analysis module 206, an LP analysis filter 208, an LP quantization module 210, and a residue quantization module 212. Input speech frames s(n) are provided to the mode decision module 202, the pitch estimation module 204, the LP analysis module 206, and the LP analysis filter 208. The mode decision module 202 produces a mode index $I_M$ and a mode M based upon the periodicity, energy, signal-to-noise ratio (SNR), or zero crossing rate, among other features, of each input speech frame s(n). Various methods of classifying speech frames according to periodicity are described in U.S. Pat. No. 5,911,128, which is assigned to the assignee of the present invention and fully incorporated herein by reference. Such methods are also incorporated into the Telecommunication Industry Association Industry Interim Standards TIA/EIA IS-127 and TIA/EIA IS-733. An exemplary mode decision scheme is also described in the aforementioned U.S. application Ser. No. 09/217,341.

The pitch estimation module 204 produces a pitch index $I_P$ and a lag value $P_0$ based upon each input speech frame s(n). The LP analysis module 206 performs linear predictive analysis on each input speech frame s(n) to generate an LP parameter a. The LP parameter a is provided to the LP quantization module 210. The LP quantization module 210 also receives the mode M, thereby performing the quantization process in a mode-dependent manner. The LP quantization module 210 produces an LP index $I_{LP}$ and a quantized LP parameter â. The LP analysis filter 208 receives the quantized LP parameter â in addition to the input speech frame s(n). The LP analysis filter 208 generates an LP residue signal R[n], which represents the error between the input speech frames s(n) and the reconstructed speech based on the quantized linear predicted parameters â. The LP residue R[n], the mode M, and the quantized LP parameter â are provided to the residue quantization module 212. Based upon these values, the residue quantization module 212 produces a residue index $I_R$ and a quantized residue signal $\hat{R}[n]$.

Figure 4:
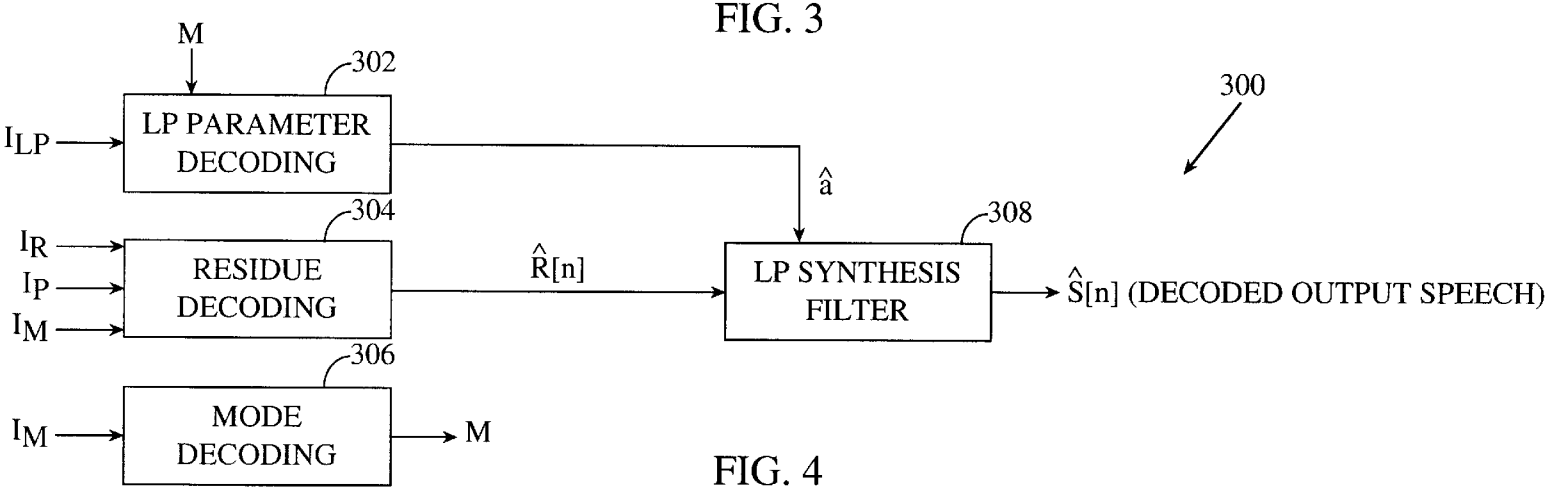
FIG. 4 is a block diagram of a decoder.

In FIG. 4 a decoder 300 that may be used in a speech coder includes an LP parameter decoding module 302, a residue decoding module 304, a mode decoding module 306, and an LP synthesis filter 308. The mode decoding module 306 receives and decodes a mode index $I_M$, generating therefrom a mode M. The LP parameter decoding module 302 receives the mode M and an LP index $I_{LP}$. The LP parameter decoding module 302 decodes the received values to produce a quantized LP parameter â. The residue decoding module 304 receives a residue index $I_R$, a pitch index $I_P$, and the mode index $I_M$. The residue decoding module 304 decodes the received values to generate a quantized residue signal $\hat{R}[n]$. The quantized residue signal $\hat{R}[n]$ and the quantized LP parameter â are provided to the LP synthesis filter 308, which synthesizes a decoded output speech signal $\hat{s}[n]$ therefrom.

Operation and implementation of the various modules of the encoder 200 of FIG. 3 and the decoder 300 of FIG. 4 are known in the art and described in the aforementioned U.S. Pat. No. 5,414,796 and L. B. Rabiner & R. W. Schafer, *Digital Processing of Speech Signals* 396–453 (1978).

Figure 5:
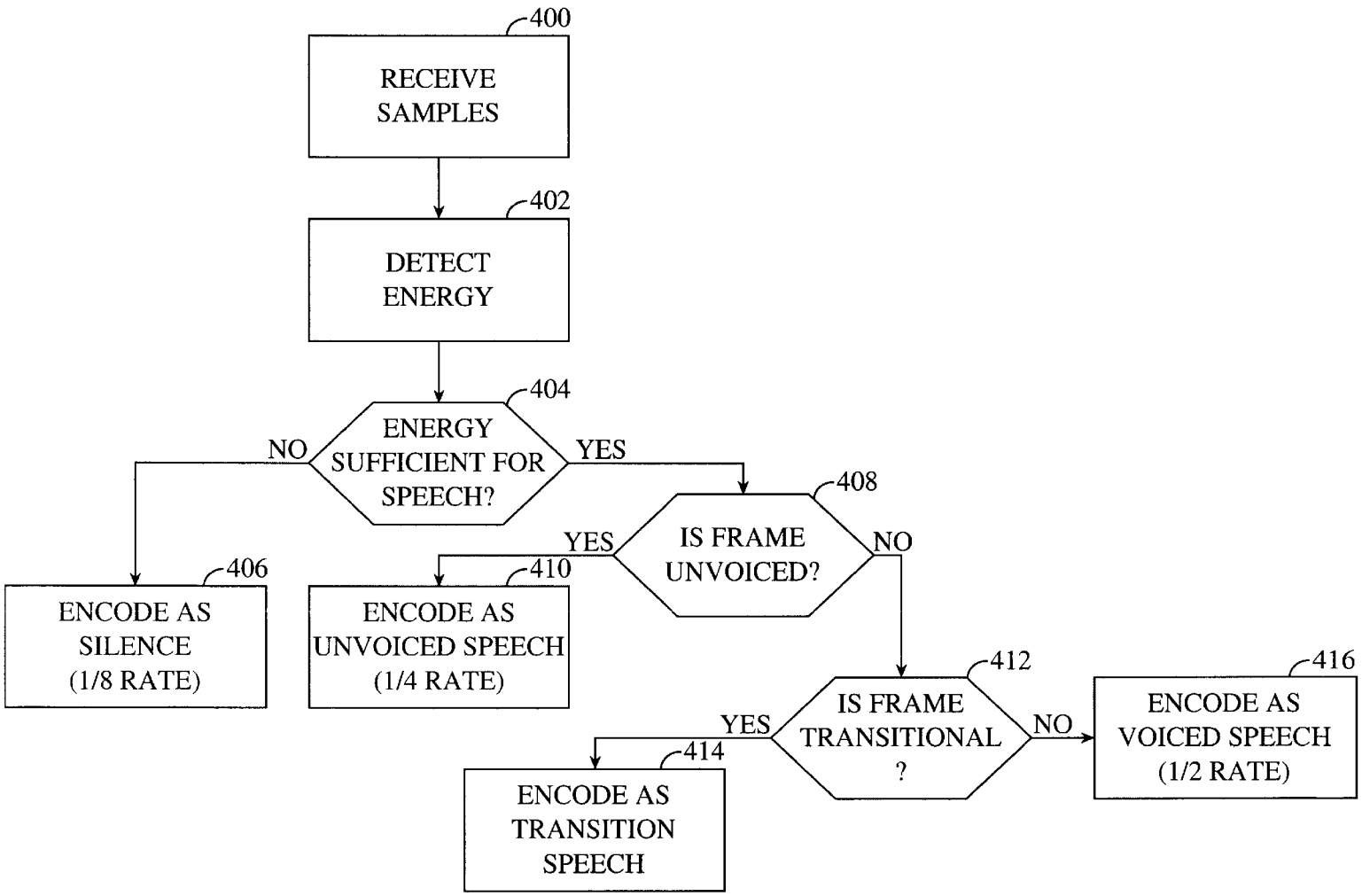
FIG. 5 is a flow chart illustrating a speech coding decision process.

As illustrated in the flow chart of FIG. 5, a speech coder in accordance with one embodiment follows a set of steps in processing speech samples for transmission. In step 400 the speech coder receives digital samples of a speech signal in successive frames. Upon receiving a given frame, the speech coder proceeds to step 402. In step 402 the speech coder detects the energy of the frame. The energy is a measure of the speech activity of the frame. Speech detection is performed by summing the squares of the amplitudes of the digitized speech samples and comparing the resultant energy against a threshold value. In one embodiment the threshold value adapts based on the changing level of background noise. An exemplary variable threshold speech activity detector is described in the aforementioned U.S. Pat. No. 5,414,796. Some unvoiced speech sounds can be extremely low-energy samples that may be mistakenly encoded as background noise. To prevent this from occurring, the spectral tilt of low-energy samples may be used to distinguish the unvoiced speech from background noise, as described in the aforementioned U.S. Pat. No. 5,414,796.

After detecting the energy of the frame, the speech coder proceeds to step 404. In step 404 the speech coder determines whether the detected frame energy is sufficient to classify the frame as containing speech information. If the detected frame energy falls below a predefined threshold level, the speech coder proceeds to step 406. In step 406 the speech coder encodes the frame as background noise (i.e., nonspeech, or silence). In one embodiment the background noise frame is encoded at ⅛ rate, or 1 kbps. If in step 404 the detected frame energy meets or exceeds the predefined threshold level, the frame is classified as speech and the speech coder proceeds to step 408.

In step 408 the speech coder determines whether the frame is unvoiced speech, i.e., the speech coder examines the periodicity of the frame. Various known methods of periodicity determination include, for example, the use of zero crossings and the use of normalized autocorrelation functions (NACFs). In particular, using zero crossings and NACFs to detect periodicity is described in the aforementioned U.S. Pat. No. 5,911,128 and U.S. application Ser. No. 09/217,341. In addition, the above methods used to distinguish voiced speech from unvoiced speech are incorporated into the Telecommunication Industry Association Interim Standards TIA/EIA IS-127 and TIA/EIA IS-733. If the frame is determined to be unvoiced speech in step 408, the speech coder proceeds to step 410. In step 410 the speech coder encodes the frame as unvoiced speech. In one embodiment unvoiced speech frames are encoded at quarter rate, or 2.6 kbps. If in step 408 the frame is not determined to be unvoiced speech, the speech coder proceeds to step 412.

In step 412 the speech coder determines whether the frame is transitional speech, using periodicity detection methods that are known in the art, as described in, for example, the aforementioned U.S. Pat. No. 5,911,128. If the frame is determined to be transitional speech, the speech coder proceeds to step 414. In step 414 the frame is encoded as transition speech (i.e., transition from unvoiced speech to voiced speech). In one embodiment the transition speech frame is encoded in accordance with a multipulse interpolative coding method described in U.S. application Ser. No. 09/307,294, entitled MULTIPULSE INTERPOLATIVE CODING OF TRANSITION SPEECH FRAMES, filed May 7, 1999, assigned to the assignee of the present invention, and fully incorporated herein by reference. In another embodiment the transition speech frame is encoded at full rate, or 13.2 kbps.

If in step 412 the speech coder determines that the frame is not transitional speech, the speech coder proceeds to step 416. In step 416 the speech coder encodes the frame as voiced speech. In one embodiment voiced speech frames may be encoded at half rate, or 6.2 kbps. It is also possible to encode voiced speech frames at full rate, or 13.2 kbps (or full rate, 8 kbps, in an 8 k CELP coder). Those skilled in the art would appreciate, however, that coding voiced frames at half rate allows the coder to save valuable bandwidth by exploiting the steady-state nature of voiced frames. Further, regardless of the rate used to encode the voiced speech, the voiced speech is advantageously coded using information from past frames, and is hence said to be coded predictively.

Figure 6A:
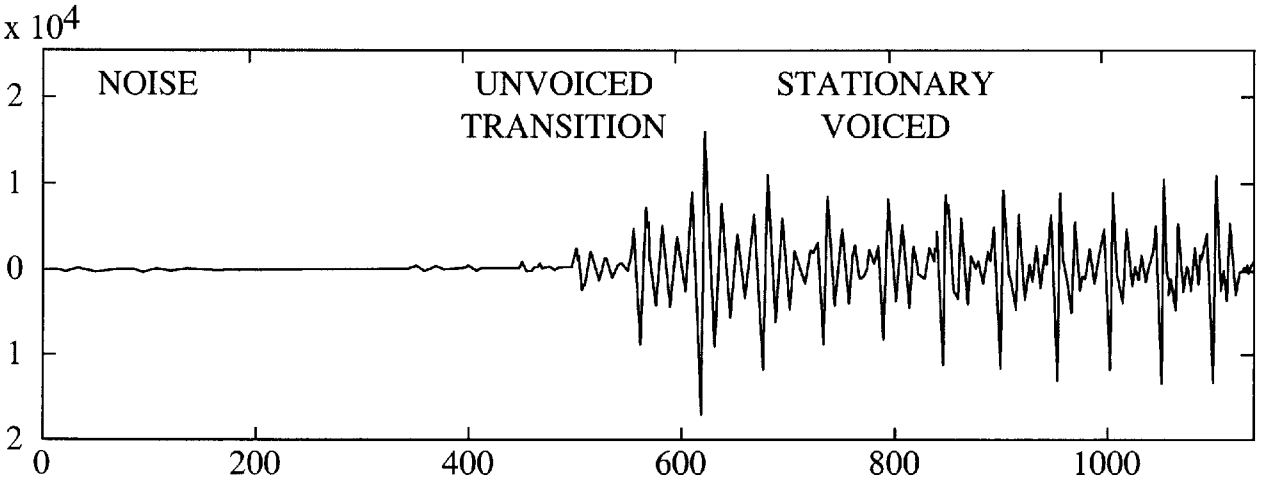
FIG. 6A is a graph speech signal amplitude versus time.
Figure 6B:
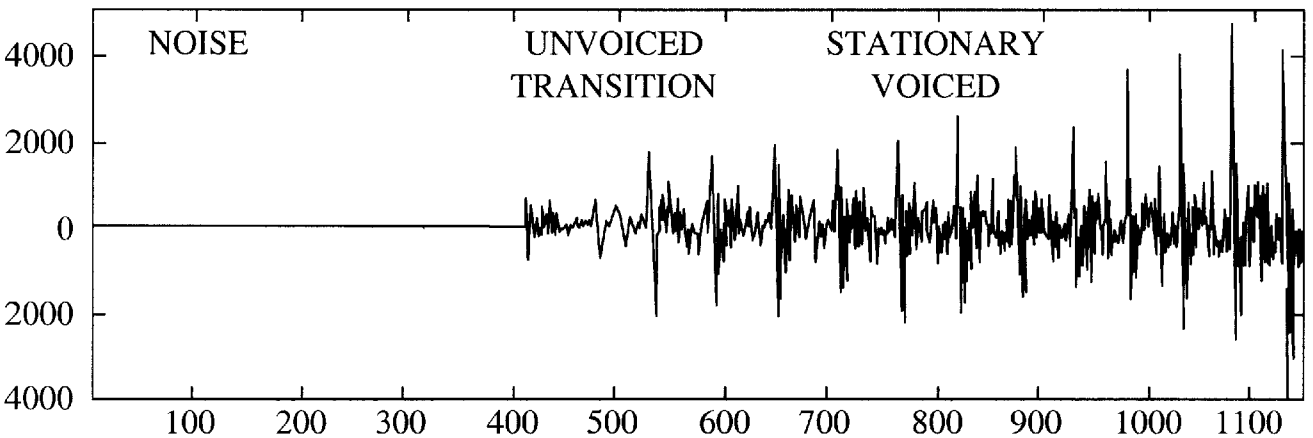
FIG. 6B is a graph of linear prediction (LP) residue amplitude versus time.

Those of skill would appreciate that either the speech signal or the corresponding LP residue may be encoded by following the steps shown in FIG. 5. The waveform characteristics of noise, unvoiced, transition, and voiced speech can be seen as a function of time in the graph of FIG. 6A. The waveform characteristics of noise, unvoiced, transition, and voiced LP residue can be seen as a function of time in the graph of FIG. 6B.

Figure 7:
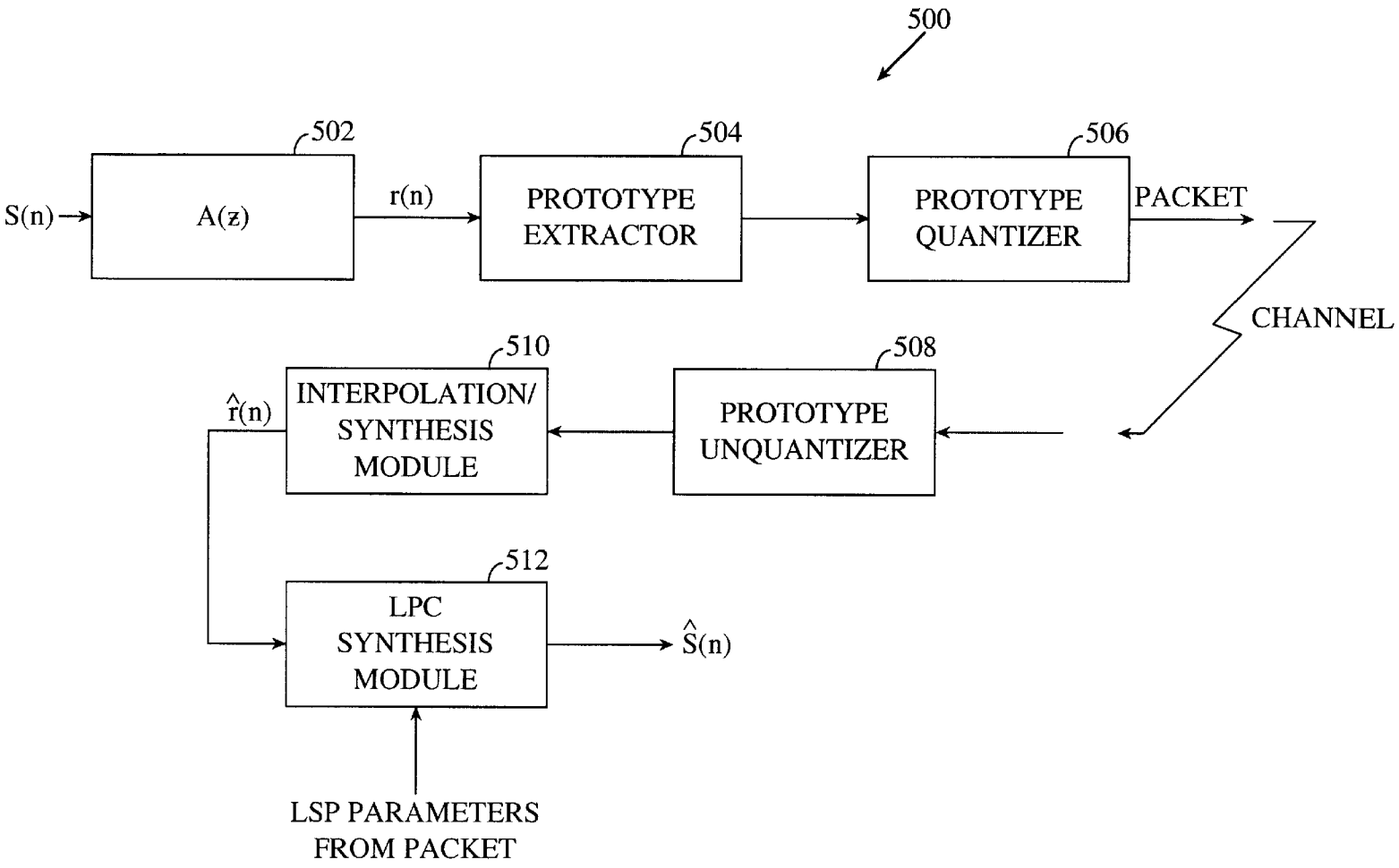
FIG. 7 is a block diagram of a prototype pitch period (PPP) speech coder.

In one embodiment a prototype pitch period (PPP) speech coder 500 includes an inverse filter 502, a prototype extractor 504, a prototype quantizer 506, a prototype unquantizer 508, an interpolation/synthesis module 510, and an LPC synthesis module 512, as illustrated in FIG. 7. The speech coder 500 may advantageously be implemented as part of a DSP, and may reside in, for example, a subscriber unit or base station in a PCS or cellular telephone system, or in a subscriber unit or gateway in a satellite system.

In the speech coder 500, a digitized speech signal s(n), where n is the frame number, is provided to the inverse LP filter 502. In a particular embodiment, the frame length is twenty ms. The transfer function of the inverse filter A(z) is computed in accordance with the following equation:

$$A(z)=1-a_1z^{-1}-a_2z^{-2}- \ldots -a_pz^{-p},$$

where the coefficients $a_1$ are filter taps having predefined values chosen in accordance with known methods, as described in the aforementioned U.S. Pat. No. 5,414,796 and U.S. application Ser. No. 09/217,494, both previously fully incorporated herein by reference. The number p indicates the number of previous samples the inverse LP filter 502 uses for prediction purposes. In a particular embodiment, p is set to ten.

The inverse filter 502 provides an LP residual signal r(n) to the prototype extractor 504. The prototype extractor 504 extracts a prototype from the current frame. The prototype is a portion of the current frame that will be linearly interpolated by the interpolation/synthesis module 510 with prototypes from previous frames that were similarly positioned within the frame in order to reconstruct the LP residual signal at the decoder.

The prototype extractor 504 provides the prototype to the prototype quantizer 506, which may quantize the prototype in accordance with any of various quantization techniques that are known in the art. The quantized values, which may be obtained from a lookup table (not shown), are assembled into a packet, which includes lag and other codebook parameters, for transmission over the channel. The packet is provided to a transmitter (not shown) and transmitted over the channel to a receiver (also not shown). The inverse LP filter 502, the prototype extractor 504, and the prototype quantizer 506 are said to have performed PPP analysis on the current frame.

The receiver receives the packet and provides the packet to the prototype unquantizer 508. The prototype unquantizer 508 may unquantize the packet in accordance with any of various known techniques. The prototype unquantizer 508 provides the unquantized prototype to the interpolation/synthesis module 510. The interpolation/synthesis module 510 interpolates the prototype with prototypes from previous frames that were similarly positioned within the frame in order to reconstruct the LP residual signal for the current frame. The interpolation and frame synthesis is advantageously accomplished in accordance with known methods described in U.S. Pat. No. 5,884,253 and in the aforementioned U.S. application Ser. No. 09/217,494.

The interpolation/synthesis module 510 provides the reconstructed LP residual signal $\hat{r}(n)$ to the LPC synthesis module 512. The LPC synthesis module 512 also receives line spectral pair (LSP) values from the transmitted packet, which are used to perform LPC filtration on the reconstructed LP residual signal $\hat{r}(n)$ to create the reconstructed speech signal $\hat{s}(n)$ for the current frame. In an alternate embodiment, LPC synthesis of the speech signal $\hat{s}(n)$ may be performed for the prototype prior to doing interpolation/synthesis of the current frame. The prototype unquantizer 508, the interpolation/synthesis module 510, and the LPC synthesis module 512 are said to have performed PPP synthesis of the current frame.

In one embodiment a PPP speech coder, such as the speech coder 500 of FIG. 7, identifies a number of frequency bands, B, for which B linear phase shifts are to be computed. The phases may advantageously be subsampled intelligently prior to quantization in accordance with methods and apparatus described in a related U.S. Application filed herewith entitled METHOD AND APPARATUS FOR SUBSAMPLING PHASE SPECTRUM INFORMATION, which is assigned to the assignee of the present invention. The speech coder may advantageously partition the discrete Fourier series (DFS) vector of the prototype of the frame being processed into a small number of bands with variable width depending upon the importance of harmonic amplitudes in the entire DFS, thereby proportionately reducing the requisite quantization. The entire frequency range from 0 Hz to Fm Hz (Fm being the maximum frequency of the prototype being processed) is divided into L segments. There is thus a number of harmonics, M, such that M is equal to Fm/of, where of Hz is the fundamental frequency. Accordingly, the DFS vector for the prototype, with constituent amplitude vector and phase vector, has M elements. The speech coder pre-allocates b1, b2, b3, . . . , bL bands for the L segments, so that b1+b2+b3+ . . . +bL is equal to B, the total number of required bands. Accordingly, there are b1 bands in the first segment, b2 bands in the second segment, etc., bL bands in the Lth segment, and B bands in the entire frequency range. In one embodiment the entire frequency range is from zero to 4000 Hz, the range of the spoken human voice.

In one embodiment bi bands are uniformly distributed in the ith segment of the L segments. This is accomplished by dividing the frequency range in the ith segment into bi equal parts. Accordingly, the first segment is divided into b1 equal bands, the second segment is divided into b2 equal bands, etc., and the Lth segment is divided into bL equal bands.

In an alternate embodiment, a fixed set of non-uniformly placed band edges is chosen for each of the bi bands in the ith segment. This is accomplished by choosing an arbitrary set of bi bands or by getting an overall average of the energy histogram across the ith segment. A high concentration of energy may require a narrow band, and a low concentration of energy may use a wider band. Accordingly, the first segment is divided into b1 fixed, unequal bands, the second segment is divided into b2 fixed, unequal bands, etc., and the Lth segment is divided into bL fixed, unequal bands.

In an alternate embodiment, a variable set of band edges is chosen for each of the bi bands in each sub-band. This is accomplished by starting with a target width of bands equal to a reasonably low value, Fb Hz. The following steps are then performed. A counter, n, is set to one. The amplitude vector is then searched to find the frequency, Fbm Hz, and the corresponding harmonic number, mb (which is equal to Fbm/Fo) of the highest amplitude value. This search is performed excluding the ranges covered by all previously set band edges (corresponding to iterations 1 through n−1). The band edges for the nth band among bi bands are then set to mb-Fb/Fo/2 and mb+Fb/Fo/2 in harmonic number, and, respectively, to Fmb-Fb/2 and Fmb+Fb/2 in Hz. The counter n is then incremented, and the steps of searching the amplitude vector and setting the band edges are repeated until the count n exceeds bi. Accordingly, the first segment is divided into b1 varying, unequal bands, the second segment is divided into b2 varying, unequal bands, etc., and the Lth segment is divided into bL varying, unequal bands.

In the embodiment described immediately above, the bands are further refined to remove any gaps between adjacent band edges. In one embodiment both the right band edge of the lower frequency band and the left band edge of the immediate higher frequency band are extended to meet in the middle of the gap between the two edges (wherein a first band located to the left of a second band is lower in frequency than the second band). One way to accomplish this is to set the two band edges to their average value in Hz (and corresponding harmonic numbers). In an alternate embodiment, one of either the right band edge of the lower frequency band or the left band edge of the immediate higher frequency band is set equal to the other in Hz (or is set to a harmonic number adjacent to the harmonic number of the other). The equalization of band edges could be made dependent on the energy content in the band ending with the right band edge and the band beginning with the left band edge. The band edge corresponding to the band having more energy could be left unchanged while the other band edge should be changed. Alternatively, the band edge corresponding to the band having higher localization of energy in its center could be changed while the other band edge would be unchanged. In an alternate embodiment, both the above-described right band edge and the above-described left band edge are moved an unequal distance (in Hz and harmonic number) with a ratio of x to y, where x and y are the band energies of the band beginning with the left band edge and of the band ending with the right band edge, respectively. Alternatively, x and y could be the ratio of the energy in the center harmonic to the total energy of the band ending with the right band edge and the ratio of the energy in the center harmonic to the total energy of the band beginning with the left band edge, respectively.

In an alternate embodiment, uniformly distributed bands could be used in some of the L segments of the DFS vector, fixed, non-uniformly distributed bands could be used in others of the L segments of the DFS vector, and variable, non-uniformly distributed bands could be used in still others of the L segments of the DFS vector.

Figure 8:
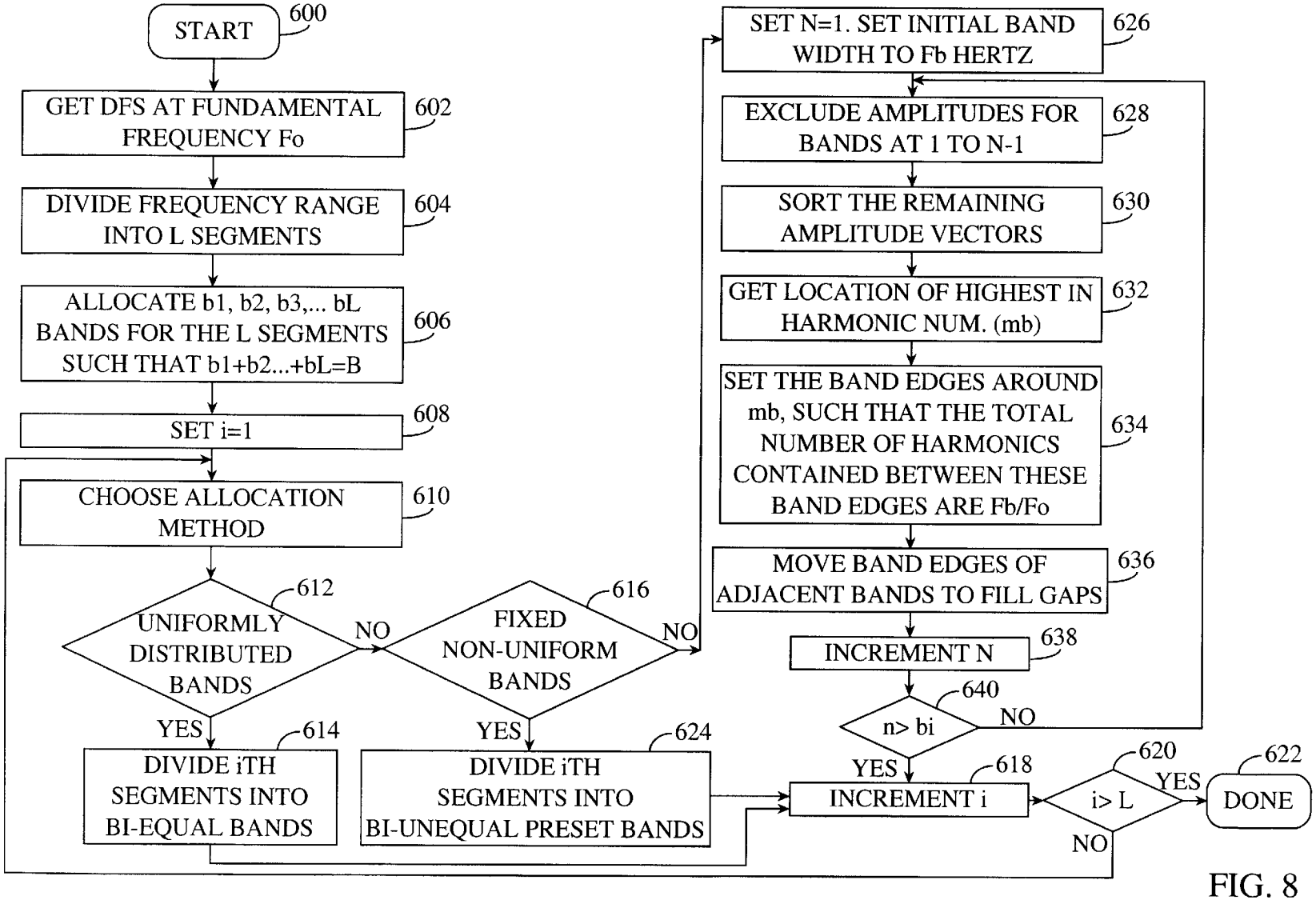
FIG. 8 is a flow chart illustrating algorithm steps performed by a PPP speech coder, such as the speech coder of FIG. 7, to identify frequency bands in a discrete Fourier series (DFS) representation of a prototype pitch period.

In one embodiment a PPP speech coder, such as the speech coder 500 of FIG. 7, performs the algorithm steps illustrated in the flow chart of FIG. 8 to identify frequency bands in a discrete Fourier series (DFS) representation of a prototype pitch period. The bands are identified for the purpose of computing alignments or linear phase shifts on the bands with respect to the DFS of a reference prototype.

In step 600 the speech coder begins the process of identifying frequency bands. The speech coder then proceeds to step 602. In step 602 the speech coder computes the DFS of the prototype at the fundamental frequency, Fo. The speech coder then proceeds to step 604. In step 604 the speech coder divides the frequency range into L segments. In one embodiment the frequency range is from zero to 4000 Hz, the range of the spoken human voice. The speech coder then proceeds to step 606.

In step 606 the speech coder allocates bL bands for the L segments such that b1+b2+ . . . +bL is equal to a total number of bands, B, for which B linear phase shifts will be computed. The speech coder then proceeds to step 608. In step 608, the speech coder sets a segment count i equal to one. The speech coder then proceeds to step 610. In step 610 the speech coder chooses an allocation method for distributing the bands in each segment. The speech coder then proceeds to step 612.

In step 612 the speech coder determines whether the band allocation method of step 610 was to distribute the bands uniformly in the segment. If the band allocation method of step 610 was to distribute the bands uniformly in the segment, the speech coder proceeds to step 614. If, on the other hand, the band allocation method of step 610 was not to distribute the bands uniformly in the segment, the speech coder proceeds to step 616.

In step 614 the speech coder divides the ith segment into bi equal bands. The speech coder then proceeds to step 618. In step 618 the speech coder increments the segment count i. The speech coder then proceeds to step 620. In step 620 the speech coder determines whether the segment count i is greater than L. If the segment count i is greater than L, the speech coder proceeds to step 622. If, on the other hand, the segment count i is not greater than L, the speech coder returns to step 610 to choose the band allocation method for the next segment. In step 622 the speech coder exits the band identification algorithm.

In step 616 the speech coder determines whether the band allocation method of step 610 was to distribute fixed, non-uniform bands in the segment. If the band allocation method of step 610 was to distribute fixed, non-uniform bands in the segment, the speech coder proceeds to step 624. If, on the other hand, the band allocation method of step 610 was not to distribute fixed, non-uniform bands in the segment, the speech coder proceeds to step 626.

In step 624 the speech coder divides the ith segment into bi unequal, preset bands. This could be accomplished using methods described above. The speech coder then proceeds to step 618, incrementing the segment count i and continuing with band allocation for each segment until bands are allocated throughout the entire frequency range.

In step 626 the speech coder sets a band count n equal to one, and sets an initial bandwidth equal to Fb Hz. The speech coder then proceeds to step 628. In step 628 the speech coder excludes amplitudes for bands in the range of from one to n−1. The speech coder then proceeds to step 630. In step 630 the speech coder sorts the remaining amplitude vectors. The speech coder then proceeds to step 632.

In step 632 the speech coder determines the location of the band that has the highest harmonic number, mb. The speech coder then proceeds to step 634. In step 634 the speech coder sets the band edges around mb such that the total number of harmonics contained between the band edges is equal to Fb/Fo. The speech coder then proceeds to step 636.

In step 636 the speech coder moves the band edges of adjacent bands to fill gaps between the bands. The speech coder then proceeds to step 638. In step 638 the speech coder increments the band count n. The speech coder then proceeds to step 640. In step 640 the speech coder determines whether the band count n is greater than bi. If the band count n is greater than bi, the speech coder proceeds to step 618, incrementing the segment count i and continuing with band allocation for each segment until bands are allocated throughout the entire frequency range. If, on the other hand, the band count n is not greater than bi, the speech coder returns to step 628 to establish the width for the next band in the segment.

Thus, a novel method and apparatus for identifying frequency bands to compute linear phase shifts between frame prototypes in a speech coder has been described. Those of skill in the art would understand that the various illustrative logical blocks and algorithm steps described in connection with the embodiments disclosed herein may be implemented or performed with a digital signal processor (DSP), an application specific integrated circuit (ASIC), discrete gate or transistor logic, discrete hardware components such as, for example, registers and FIFO, a processor executing a set of firmware instructions, or any conventional programmable software module and a processor. The processor may advantageously be a microprocessor, but in the alternative, the processor may be any conventional processor, controller, microcontroller, or state machine. The software module could reside in RAM memory, flash memory, registers, or any other form of writable storage medium known in the art. Those of skill would further appreciate that the data, instructions, commands, information, signals, bits, symbols, and chips that may be referenced throughout the above description are advantageously represented by voltages, currents, electromagnetic waves, magnetic fields or particles, optical fields or particles, or any combination there.

Preferred embodiments of the present invention have thus been shown and described. It would be apparent to one of ordinary skill in the art, however, that numerous alterations may be made to the embodiments herein disclosed without departing from the spirit or scope of the invention. Therefore, the present invention is not to be limited except in accordance with the following claims.

What is claimed is:

1. A method of partitioning the frequency spectrum of a prototype of a frame, comprising the steps of:

dividing the frequency spectrum into a plurality of segments;

assigning a plurality of bands to each segment;

establishing, for each segment, a set of bandwidths for the plurality of bands, wherein the establishing step comprises the step of allocating variable bandwidths to the plurality of bands in a particular segment, and wherein the allocating step comprises the steps of:

setting a target bandwidth;

searching, for each band, an amplitude vector of the prototype to determine the maximum harmonic number in the band, excluding from the search ranges covered by any previously established band edges;

positioning, for each hand, the band edges around the maximum harmonic number such that the total number of harmonics located between the band edges is equal to the target bandwidth divided by the fundamental frequency; and removing gaps between adjacent band edges.

2. The method of claim 1, wherein the removing step comprises the step of setting, for each gap, the adjacent band edges enclosing the gap equal to the average frequency value of the two adjacent band edges.

3. The method of claim 1, wherein the removing step comprises the step of setting, for each gap, the adjacent band edge corresponding to the band with lesser energy equal to the frequency value of the adjacent band edge corresponding to the band with greater energy.

4. The method of claim 1, wherein the removing step comprises the step of setting, for each gap, the adjacent band edge corresponding to the band with higher localization of energy in the center of the band equal to the frequency value of the adjacent band edge corresponding to the band with lower localization of energy in the center of the band.

5. The method of claim 1, wherein the removing step comprises the step of adjusting, for each gap, the frequency values of the two adjacent band edges, the frequency value of the adjacent band edge corresponding to the band having higher frequencies being adjusted relative to the adjustment of the frequency value of the adjacent band edge having lower frequencies by a ratio of x to y, wherein x is the band energy of the adjacent band having higher frequencies, and y is the band energy of the adjacent band having lower frequencies.

6. The method of claim 1, wherein the removing step comprises the step of adjusting, for each gap, the frequency values of the two adjacent band edges, the frequency value of the adjacent band edge corresponding to the band having higher frequencies being adjusted relative to the adjustment of the frequency value of the adjacent band edge having lower frequencies by a ratio of x to y, wherein x is the ratio of the energy in the center harmonic of the adjacent band having lower frequencies to the total energy of the adjacent band having lower frequencies, and y is the ratio of the energy in the center harmonic of the adjacent band having higher frequencies to the total energy of the adjacent band having higher frequencies.

7. A speech coder configured to partition the frequency spectrum of a prototype of a frame, comprising:

means for dividing the frequency spectrum into a plurality of segments;

means for assigning a plurality of bands to each segment; and means for establishing, for each segment, a set of bandwidths for the plurality of bands, wherein the means for establishing comprises means for allocating variable bandwidths to the plurality of bands in a particular segment, and wherein the means for allocating comprises:

means for setting a target bandwidth;

means for searching, for each band, an amplitude vector of the prototype to determine the maximum harmonic number in the band, excluding from the search ranges covered by any previously established band edges;

means for positioning, for each band, the band edges around the maximum harmonic number such that the total number of harmonics located between the band edges is equal to the target bandwidth divided by the fundamental frequency; and means for removing gaps between adjacent band edges.

8. The speech coder of claim 7, wherein the means for removing comprises means for setting, for each gap, the adjacent band edges enclosing the gap equal to the average frequency value of the two adjacent band edges.

9. The speech coder of claim 7, wherein the means for removing comprises means for setting, for each gap, the adjacent band edge corresponding to the band with lesser energy equal to the frequency value of the adjacent band edge corresponding to the band with greater energy.

10. The speech coder of claim 7, wherein the means for removing comprises means for setting, for each gap, the adjacent band edge corresponding to the band with higher localization of energy in the center of the band equal to the frequency value of the adjacent band edge corresponding to the band with lower localization of energy in the center of the band.

11. The speech coder of claim 7, wherein the means for removing comprises means for adjusting, for each gap, the frequency values of the two adjacent band edges, the frequency value of the adjacent band edge corresponding to the band having higher frequencies being adjusted relative to the adjustment of the frequency value of the adjacent band edge having lower frequencies by a ratio of x to y, wherein x is the band energy of the adjacent band having higher frequencies, and y is the band energy of the adjacent band having lower frequencies.

12. The speech coder of claim 7, wherein the means for removing comprises means for adjusting, for each gap, the frequency values of the two adjacent band edges, the frequency value of the adjacent band edge corresponding to the band having higher frequencies being adjusted relative to the adjustment of the frequency value of the adjacent band edge having lower frequencies by a ratio of x to y, wherein x is the ratio of the energy in the center harmonic of the adjacent band having lower frequencies to the total energy of the adjacent band having lower frequencies, and y is the ratio of the energy in the center harmonic of the adjacent band having higher frequencies to the total energy of the adjacent band having higher frequencies.

13. A speech coder comprising:

a prototype extractor configured to extract a prototype from a frame being processed by the speech coder; and a prototype quantizer coupled to the prototype extractor and configured to divide the frequency spectrum of the prototype into a plurality of segments, assign a plurality of bands to each segment, and establish, for each segment, a set of bandwidths for the plurality of bands, wherein the prototype quantizer is further configured to establish the set of bandwidths as variable bandwidths for the plurality of bands in a particular segment, and wherein the prototype quantizer is further configured to set the variable bandwidths by setting a target bandwidth, searching, for each band, an amplitude vector of the prototype to determine the maximum harmonic number in the band, excluding from the search ranges covered by any previously established band edges, positioning, for each band, the band edges around the maximum harmonic number such that the total number of harmonics located between the band edges is equal to the target bandwidth divided by the fundamental frequency, and removing gaps between adjacent band edges.

14. The speech coder of claim 13, wherein the prototype quantizer is further configured to remove the gaps by setting, for each gap, the adjacent band edges enclosing the gap equal to the average frequency value of the two adjacent band edges.

15. The speech coder of claim 13, wherein the prototype quantizer is further configured to remove the gaps by setting, for each gap, the adjacent band edge corresponding to the band with lesser energy equal to the frequency value of the adjacent band edge corresponding to the band with greater energy.

16. The speech coder of claim 13, wherein the prototype quantizer is further configured to remove the gaps by setting, for each gap, the adjacent band edge corresponding to the band with higher localization of energy in the center of the band equal to the frequency value of the adjacent band edge corresponding to the band with lower localization of energy in the center of the band.

17. The speech coder of claim 13, wherein the prototype quantizer is further configured to remove the gaps by adjusting, for each gap, the frequency values of the two adjacent band edges, the frequency value of the adjacent band edge corresponding to the band having higher frequencies being adjusted relative to the adjustment of the frequency value of the adjacent band edge having lower frequencies by a ratio of x to y, wherein x is the band energy of the adjacent band having higher frequencies, and y is the band energy of the adjacent band having lower frequencies.

18. The speech coder of claim 13, wherein the prototype quantizer is further configured to remove the gaps by adjusting, for each gap, the frequency values of the two adjacent band edges, the frequency value of the adjacent band edge corresponding to the band having higher frequencies being adjusted relative to the adjustment of the frequency value of the adjacent band edge having lower frequencies by a ratio of x to y, wherein x is the ratio of the energy in the center harmonic of the adjacent band having lower frequencies to the total energy of the adjacent band having lower frequencies, and y is the ratio of the energy in the center harmonic of the adjacent band having higher frequencies to the total energy of the adjacent band having higher frequencies.

* * * * *